US008007377B2

(12) United States Patent
Pearce

(10) Patent No.: US 8,007,377 B2
(45) Date of Patent: Aug. 30, 2011

(54) GOLF GREEN REPAIR TOOL

(76) Inventor: Frank G. Pearce, Richardson, TX (US)

( * ) Notice: Subject to any disclaimer, the term of this patent is extended or adjusted under 35 U.S.C. 154(b) by 150 days.

(21) Appl. No.: 12/564,261

(22) Filed: Sep. 22, 2009

(65) Prior Publication Data

US 2010/0234142 A1 Sep. 16, 2010

Related U.S. Application Data

(60) Provisional application No. 61/210,040, filed on Mar. 13, 2009.

(51) Int. Cl.
*A63B 57/00* (2006.01)

(52) U.S. Cl. ..... 473/408

(58) Field of Classification Search ..... 473/408, 473/286; D21/793; 172/614, 684
See application file for complete search history.

(56) References Cited

U.S. PATENT DOCUMENTS 4,005,757 A * 2/1977 Hess ..... 172/710
5,755,629 A * 5/1998 Blomgren ..... 473/408
5,759,120 A * 6/1998 Mathis et al. ..... 473/408
D434,825 S * 12/2000 Miura ..... D21/793
6,572,495 B1 * 6/2003 Ferrari ..... 473/408
6,699,144 B1 * 3/2004 Kvitek ..... 473/408
6,939,254 B2 * 9/2005 Tiefel ..... 473/408
6,942,584 B2 * 9/2005 Kvitek ..... 473/408
6,994,639 B2 * 2/2006 Parks et al. ..... 473/408
6,997,824 B2 * 2/2006 Cranman ..... 473/408
D538,374 S * 3/2007 Dow ..... D21/793
7,238,126 B1 7/2007 Wiens et al.
2007/0149325 A1 * 6/2007 Vargas ..... 473/408

* cited by examiner

*Primary Examiner* — Steven Wong
(74) *Attorney, Agent, or Firm* — Donald J. Ersler

(57) ABSTRACT

A golf ball turf repair tool preferably includes a handle member, a fork member and a pivot pin. The fork member includes a pivot base, at least one fork and a support projection. The at least one fork extends from one end of the pivot base and the support projection extends from the other end of the pivot base. The handle member preferably includes a substantially concave top surface, a pivot base slot and a support projection pocket. A pivot pin is inserted through an end of the handle member and pivot base. The fork member of the turf repair tool is inserted into the turf adjacent a ball crater. If the user attempts to rotate the turf repair tool clockwise relative to the turf, the turf repair tool will collapse and fold. If the turf repair tool is rotated counterclockwise, the turf repair tool will repair the ball crater.

19 Claims, 2 Drawing Sheets

GOLF GREEN REPAIR TOOL

CROSS-REFERENCES TO RELATED APPLICATIONS

This is a nonprovisional application taking priority from provisional application No. 61/210,040, filed on Mar. 13, 2009.

BACKGROUND OF THE INVENTION

1. Field of the Invention

The present invention relates generally to golfing and more specifically to a golf ball turf repair tool, which is used for repairing golf green turf damage caused by golf ball impact during a game of golf as well as other turf irregularities on the golf green.

2. Discussion of the Prior Art

In the game of golf, irregularities, including indentations, are often encountered on the surface of golf greens. These irregularities may have numerous causes, such as the impact of a golf ball landing on the green during a golf shot. The accepted golf etiquette requires the golfer to attempt to repair such irregularities to the turf of the green caused by his or her actions. Furthermore, it is to all golfers' advantage to repair all irregularities that may affect the roll of the golf ball during the act of putting.

A number of devices have been developed to assist and equip the golfer to repair irregularities on the turf of the green. These turf repair devices are generally referred to as divot tools, pitch mark repair tools, or ball mark repair tools, and come in a variety of shapes and designs, including those with multi-functions, such as providing a cigar holder, bottle top opener, and the like. Such turf repair tools are made by many manufacturers in various materials, including metal, plastic, and wood.

The most common type of turf repair tool has a single portion base member and one or more tines to penetrate the turf during repair and is compact enough to be carried by the golfer in a pocket, or on a key chain, and the like. Often this type of turf repair tool is made inexpensively of plastic and is provided by the golf course management to the golfers either as a complimentary item or at a very low cost, with the intention of encouraging the golfer to repair irregularities in the greens during play. Heavier, more expensive turf repair tools, often with company or sports logos, can also be purchased for this purpose. Although each of these various turf repair tool configurations is able to mend the irregularities in the golf green, each fails to address a major concern in turf repair. That is, a significant percentage of golfers employ an incorrect method in attempting to employ the turf repair tool that does not mend the irregularity and, in fact, produces more damage to the greens.

It is well accepted by those versed in the maintenance and care of golf courses that the preferred method of turf repair, and particularly in repairing ball marks, is to insert the tine(s) of the turf repair tool at an oblique angle along the edge of the ball mark and to push the base of the tool up and inward toward the center of the ball mark. However, it is further known that a high percentage of golfers do not know or employ this method and in fact, utilize an incorrect procedure of pushing down on the base of the tool in an effort to lift up the turf in the center of the ball mark or irregularity. Not only does this method fail to repair the irregularity, but it causes additional damage to the turf and turf roots.

One attempt to address the problem of incorrect use of a turf repair tool is shown by U.S. Pat. No. 7,238,126 to Wiens et al. The Wiens et al patent discloses a golf green repair device method and apparatus that includes a golf green repair tool with a depth limiting feature. Although such a feature can reduce damage to the green when used incorrectly, scientific studies have shown that such a depth limiting feature does not adequately raise the center of the ball mark crater or irregularity to the level of the surrounding surface of the green, thus resulting in an uneven surface that affects the true roll of a golf ball during putting.

Accordingly, there is a clearly felt need in the art for a golf ball turf repair tool, which encourages the correct method of ball mark repair, while discouraging the incorrect method of repair.

SUMMARY OF THE INVENTION

The present invention provides a golf ball turf repair tool for use in repairing golf green turf damage caused by golf ball impact. The golf ball turf repair tool (turf repair tool) preferably includes a handle member, a fork member and a pivot pin. The fork member preferably includes a pivot base, at least one fork and a support projection. The at least one fork extends from one end of the pivot base and the support projection extends from the other end of the pivot base. The handle member preferably includes a substantially concave top surface, a pivot base slot and a support projection pocket. A pivot base cross hole is formed through the pivot base to receive the pivot pin and a handle cross hole is formed through an end of the handle member concentric with the pivot base cross hole to receive the pivot pin. The fork member of the turf repair tool is inserted into the turf adjacent a ball crater. If the user attempts to rotate the turf repair tool clockwise relative to the turf, the turf repair tool will collapse and fold. However, if the turf repair tool is rotated counterclockwise, the support projection will be supported by the support projection pocket and the turf repair tool will repair the ball crater.

Accordingly, it is an object of the present invention to provide a turf repair tool, which encourages the correct method of ball mark repair, while discouraging the incorrect method of repair.

Finally, it is another object of the present invention to provide a turf repair tool, which is used for repairing golf green turf damage caused by golf ball impact during a game of golf as well as other turf irregularities on the golf green.

These and additional objects, advantages, features and benefits of the present invention will become apparent from the following specification.

DETAILED DESCRIPTION OF THE PREFERRED EMBODIMENTS

Figure 1:
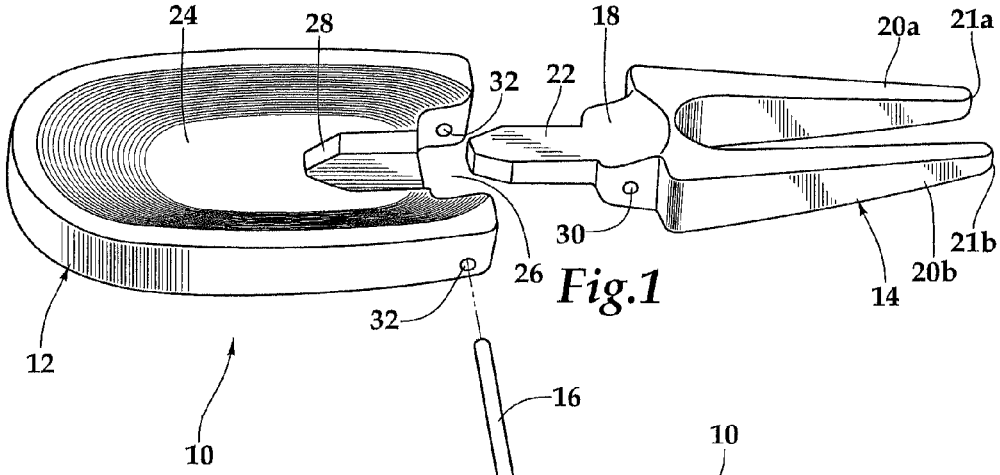
FIG. 1 is an exploded perspective view of a turf repair tool in accordance with the present invention.
Figure 2:
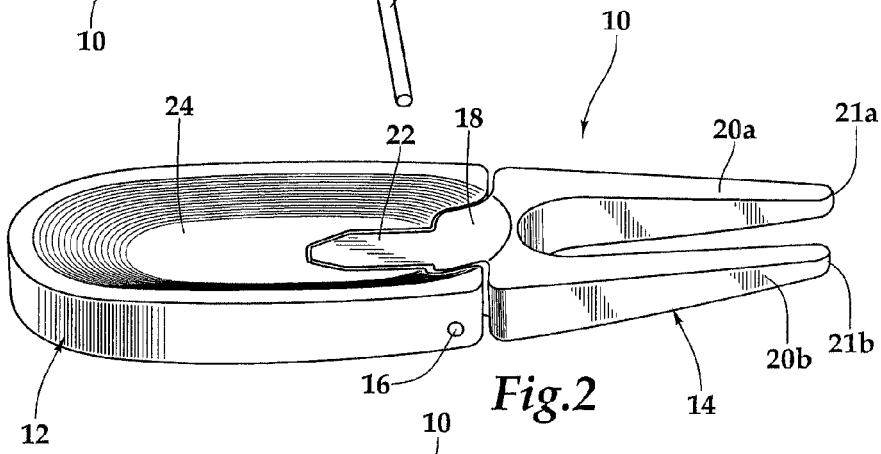
FIG. 2 is a perspective view of a turf repair tool in accordance with the present invention.
Figure 3:
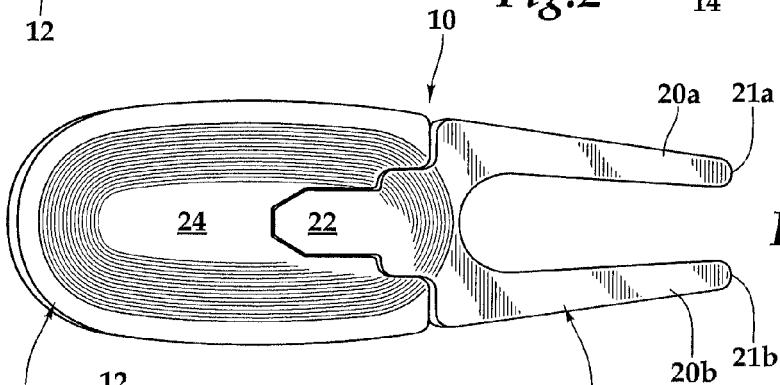
FIG. 3 is a top view of a turf repair tool in accordance with the present invention.
Figure 4:
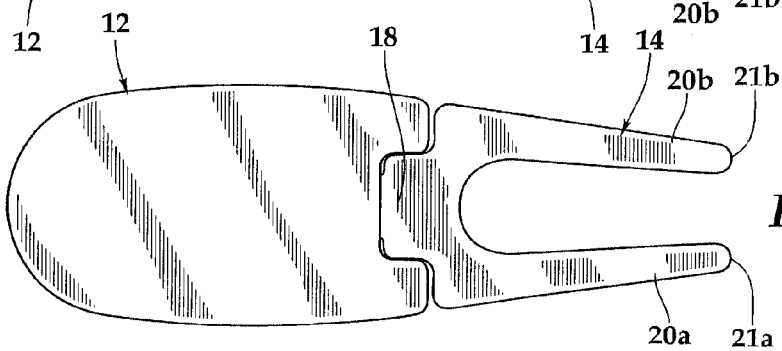
FIG. 4 is a bottom view of a turf repair tool in accordance with the present invention.

With reference now to the drawings, and particularly to FIG. 1, there is shown an exploded perspective view of a turf repair tool 10. With reference to FIGS. 2-4, the turf repair tool 10 preferably includes a handle member 12, a fork member 14 and a pivot pin 16. The fork member 14 preferably includes a pivot base 18, at least one fork and a support projection 22. A pair of forks 20*a*, 20*b* extend from one end of the pivot base 18 and the support projection 22 extends from the other end of the pivot base 18. The pair of forks 20*a*,20*b* are preferably tapered to assist with insertion into turf. The narrowest portion of the forks 20*a*,20*b* being on the insertion ends 21*a*,21*b* thereof.

The handle member 12 preferably includes a substantially concave top surface 24, a pivot base slot 26 and a support projection pocket 28. A pivot base cross hole 30 is formed through the pivot base to receive the pivot pin 16 and a handle cross hole 32 is formed through an end of the handle member 12, concentric with the pivot base cross hole 30 to receive the pivot pin 16. The support projection 22 allows the turf repair tool 10 to be used in only one direction. However, the pivot pin 16 may be replaced with any suitable structure, which allows the handle member 12 to pivot relative to the fork member 14.

Figure 5:
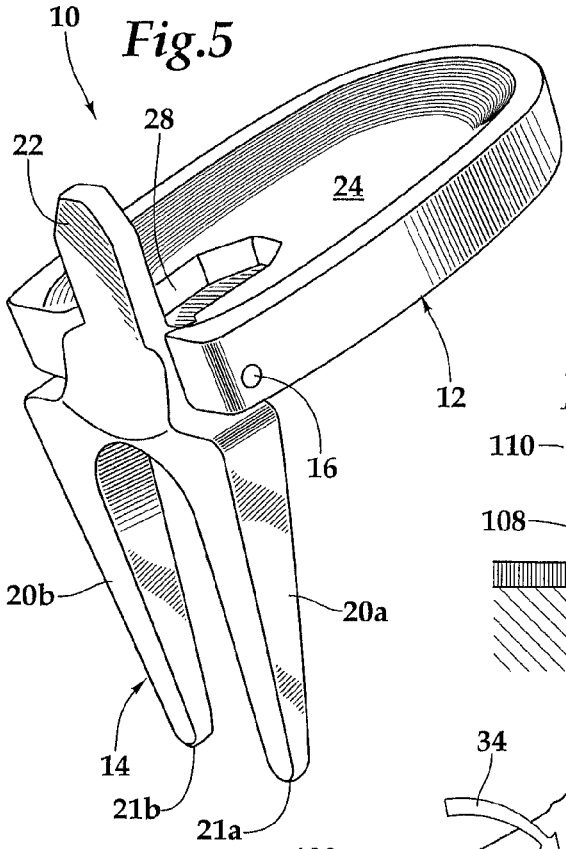
FIG. 5 is a perspective view of a turf repair tool in a collapsed or folded position in accordance with the present invention.

In the correct direction, the support projection 22 is supported by the support projection pocket 28. A top of the support projection 22 is preferably substantially flush with a bottom of the concave top surface 24, when the support projection contacts a bottom of the support projection pocket 28. However, if the turf repair tool 10 is used in the wrong direction it will collapse or fold as shown in FIG. 5.

Figure 6:
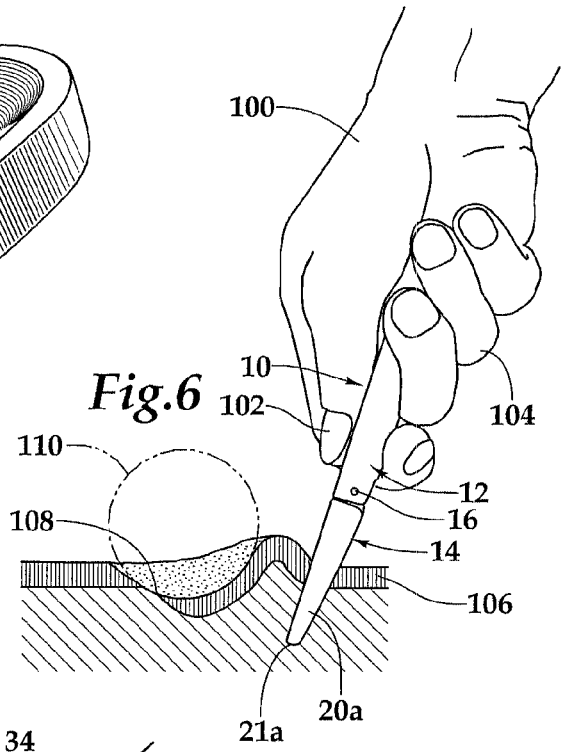
FIG. 6 is a side view of a turf repair tool inserted into a turf green adjacent a ball crater in accordance with the present invention.
Figure 7:
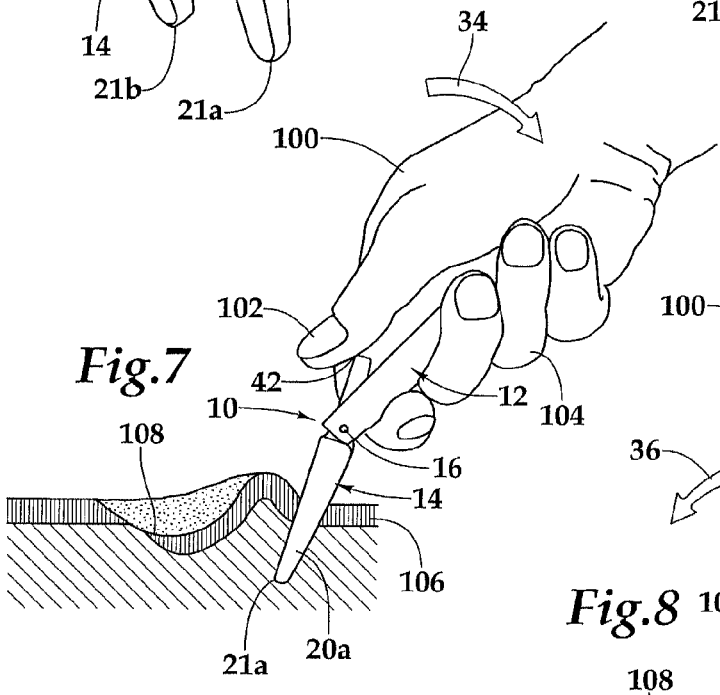
FIG. 7 is a side view of an attempt to incorrectly clockwise rotate a turf repair tool relative to a ball crater in accordance with the present invention.
Figure 8:
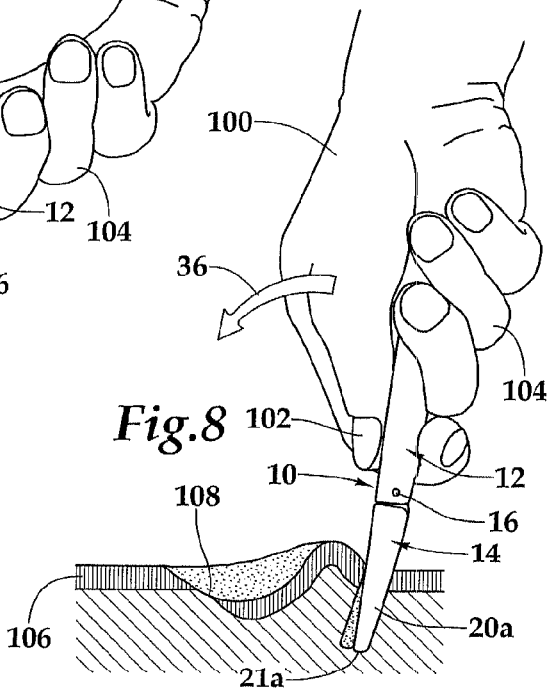
FIG. 8 is a side view of an attempt to correctly counterclockwise rotate a turf repair tool relative to a ball crater in accordance with the present invention.

With reference to FIGS. 6-8, a user places their thumb 102 of their hand 100 over the support projection 22 and their fingers 104 are curled around a bottom of the handle member 12. The fork member 14 of the turf repair tool 10 is inserted into the turf 106 adjacent a ball crater 108 created by a golf ball 110. If the user attempts to rotate the turf repair tool 10 clockwise 34 relative to the turf 106, the turf repair tool 14 will collapse and fold. However, if the turf repair tool 10 is rotated counterclockwise 36, the turf repair tool 10 will repair the ball crater 108. As shown in FIG. 6, a length of the fork forms a substantially straight line with a length of the handle member when the golf ball turf repair tool is used properly to repair a ball mark.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A golf ball turf repair tool comprising:

a fork member including a pivot base, at least one fork and a support projection, said at least one fork extends from one end of said pivot base and said support projection extends from the other end of said pivot base; and a handle member including a pivot base slot, said pivot base slot being sized to receive said pivot base, said support projection being supported by said handle member, said fork member being pivotally engaged with said handle member, wherein a length of said fork forms a substantially straight line with a length of said handle member when said golf ball turf repair tool is used properly to repair a ball mark.

2. The golf ball turf repair tool of claim 1 wherein:

a support projection pocket being formed in said handle member, said support projection pocket being sized to receive said support projection.

3. The golf ball turf repair tool of claim 1 wherein:

a substantially concave top surface being formed in a top of said handle member.

4. The golf ball turf repair tool of claim 3 wherein:

a top of said support projection being substantially flush with a top of said substantially top concave surface.

5. The golf ball turf repair tool of claim 1, further comprising:

a pivot pin being inserted through an end of said handle member and said pivot base.

6. The golf ball turf repair tool of claim 1 wherein:

said at least one fork being tapered, a narrowest portion of said taper being on an insertion end thereof.

7. The golf ball turf repair tool of claim 1, further comprising:

said fork member pivoting relative to said handle member when inserted into turf and said golf ball turf repair tool is used improperly.

8. A golf ball turf repair tool comprising:

a fork member including a pivot base, at least one fork and a support projection, said at least one fork extends from one end of said pivot base and said support projection extends from the other end of said pivot base; and a handle member including a pivot base slot and a support projection pocket, said pivot base slot being sized to receive said pivot base, said support projection pocket being sized to receive said support projection, said fork member being pivotally engaged with said handle member, wherein a length of said fork forms a substantially straight line with a length of said handle member when said golf ball turf repair tool is used properly to repair a ball mark.

9. The golf ball turf repair tool of claim 8 wherein:

a substantially concave top surface being formed in a top of said handle member.

10. The golf ball turf repair tool of claim 9 wherein:

a top of said support projection being substantially flush with a top of said substantially top concave surface.

11. The golf ball turf repair tool of claim 8, further comprising:

a pivot pin being inserted through an end of said handle member and said pivot base.

12. The golf ball turf repair tool of claim 8 wherein:

said at least one fork being tapered, a narrowest portion of said taper being on an insertion end thereof.

13. The golf ball turf repair tool of claim 8, further comprising:

said fork member pivoting relative to said handle member when inserted into turf and said golf ball turf repair tool is used improperly.

14. A golf ball turf repair tool comprising:

a fork member including a pivot base, at least one fork and a support projection, said at least one fork extends from one end of said pivot base and said support projection extends from the other end of said pivot base;

a handle member including a pivot base slot, said pivot base slot being sized to receive said pivot base, said support projection being supported by said handle member, wherein a length of said fork forms a substantially straight line with a length of said handle member when said golf ball turf repair tool is used properly to repair a ball mark; and a pivot pin being inserted through an end of said handle member and said pivot base.

15. The golf ball turf repair tool of claim 14 wherein:

a support projection pocket being formed in said handle member, said support projection pocket being sized to receive said support projection.

16. The golf ball turf repair tool of claim 15 wherein:

a substantially concave top surface being formed in a top of said handle member.

17. The golf ball turf repair tool of claim 16 wherein:

a top of said support projection being substantially flush with a top of said substantially top concave surface.

18. The golf ball turf repair tool of claim 14 wherein:

said at least one fork being tapered, a narrowest portion of said taper being on an insertion end thereof.

19. The golf ball turf repair tool of claim 14, further comprising:

said fork member pivoting relative to said handle member when inserted into turf and said golf ball turf repair tool is used improperly.

* * * * *